United States Patent [19]

Shimoyama et al.

[11] 4,358,093

[45] Nov. 9, 1982

[54] STEEL STRIP CONTINUOUS ANNEALING FURNACE

[75] Inventors: Yuji Shimoyama; Fumiya Yanagishima, both of Ichihara; Hideo Sunami, Chiba; Munetoshi Suzuki, Chiba; Hiromasa Yamamoto, Chiba; Gunji Sakamoto, Chiba, all of Japan

[73] Assignee: Kawasaki Steel Corporation, Hyogo, Japan

[21] Appl. No.: 199,200

[22] Filed: Oct. 21, 1980

[30] Foreign Application Priority Data

Oct. 31, 1979 [JP] Japan ..... 54-141506

[51] Int. Cl.[3] ..... C21D 9/54

[52] U.S. Cl. ..... 266/103; 266/111; 266/252; 266/259

[58] Field of Search ..... 266/274, 249, 251, 252, 266/259, 78, 102, 103, 111; 432/59, 60; 242/75.3; 226/104, 107, 118, 119

[56] References Cited

U.S. PATENT DOCUMENTS

| | | | |
|---|---|---|---|
| 3,060,945 | 10/1962 | Spenle | 226/118 |
| 3,269,714 | 8/1966 | McKie | 266/102 |
| 3,381,868 | 5/1968 | Vogeler | 226/118 |
| 3,752,459 | 8/1973 | Kawazoko et al. | 266/111 |
| 3,805,571 | 4/1974 | Toda et al. | 266/111 |
| 3,877,684 | 4/1975 | Kurihara et al. | 266/111 |
| 4,012,028 | 3/1977 | Izrailevich et al. | 266/103 |
| 4,060,186 | 11/1977 | Nabhan | 226/118 |

FOREIGN PATENT DOCUMENTS 52-30928 8/1977 Japan.

OTHER PUBLICATIONS

Coughanour et al., *Process Systems Analysis and Control,* McGraw-Hill Book Co., 1965, pp. 102-104.

Araki et al., "Development of Continuously Annealed High Strength Cold Rolled Sheet Steels," Transactions ISIJ, vol. 17, 1977, pp. 701-709.

Toda et al., "Metallurgical Investigations on Continuous Annealing of Low-carbon Capped-steel Sheets", Transactions ISIJ, vol. 15, 1975, pp. 305-313.

Kubotera et al., "Development of a Continuous Annealing Process for the Drawing Quality Steel Strip", Transactions ISIJ, vol. 17, 1977, pp. 663-670.

Toda et al., "Production of Drawing-quality Steel Sheet by Continuous Annealing and Processing", Sheet Metal Industries, Sep. 1974, pp. 586-593.

Masumoto, "No. 2 Continuous Annealing Line for Drawing Quality Cold Strip at Nippon Kokan, Fukuyama Works", Steel Times, Jan. 1977, pp. 63-68.

Toda et al., "World's First Continuous Annealing and Processing Line for Cold Rolled Strip", Iron and Steel Engineer, Oct. 1973, pp. 21-24.

Toda et al., "Production of Drawing-quality Steel Sheet by Continuous Annealing and Processing", Sheet Metal Industries, Sep. 1974, pp. 25-29.

Automotive Industries, Sep. 1, 1974, pp. 30-31.

*Primary Examiner*—John P. Sheehan

*Attorney, Agent, or Firm*—Koda and Androlia

[57] ABSTRACT

A steel strip continuous annealing furnace comprises a heating zone, a soaking zone and cooling zones, wherein bridle rolls for isolating tension of a steel strip from those in adjacent sections of the steel strip are provided at the inlet and outlet of the furnace and in the furnace so as to define a plurality of tension control blocks and provide tension control mechanisms for controlling the tensions of the steel strip in the respective tension control blocks, so that appropriate tensions can be rendered to the steel strip in the respective zones of the furnace, thereby enabling to secure the safe and satisfactory operating conditions.

5 Claims, 4 Drawing Figures

STEEL STRIP CONTINUOUS ANNEALING FURNACE

BACKGROUND OF THE INVENTION

1. Field of the Invention

The present invention relates to steel strip continuous annealing furnaces, and more particularly to a steel strip continuous annealing furnace comprising a heating zone, a soaking zone and cooling zones.

2. Description of the Prior Art

Recently, annealing processes for rendering predetermined processability, deep drawing properties and the like to cold-rolled steel strip have been carried out by continuous annealing furnaces. These continuous annealing furnaces each comprise a heating zone for heating the steel strip to a predetermined temperature, a soaking zone for holding the steel strip at a predetermined soaking temperature and a cooling zone for cooling the steel strip to substantially room temperature. The cooling zone further includes a rapidly cooling zone for rapidly cooling the steel strip at a predetermined cooling rate, a controlled cooling zone for controlled cooling the steel strip or holding same at a predetermined temperature to effect overaging treatment, and the like. Consequently, the abovedescribed continuous annealing furnace generally forms a long continuous line, and therefore, it is necessary to render appropriate tensions to the steel strip in the furnace in order to maintain stabilized operating conditions in the furnace.

FIG. 1 is an explanatory view showing the conventional continuous annealing furnace for annealing the black tinplates, silicon steel sheets and the like and the tension of the steel strip in the furnace. In this continuous annealing furnace, the steel strip is annealed through the heating zone 1, soaking zone 2, controlled cooling zone 3 and rapidly cooling zone 4 as the cooling zones, the thereafter, carried out of the furnace. Furthermore, the continuous annealing furnace is provided at the inlet and outlet thereof with bridle rolls 5 for isolating the tension of the steel strip from those in adjacent sections of the steel strip, and the motor torque applied to a dancer roll 6 interposed between the bridle roll 5 at the inlet and the inlet of the heating zone 1 is changed, so that the tension of the steel strip in the furnace can be varied.

However, since the steel strip is progressively heated to be thermally expanded in the heating zone 1, there is a possibility that the steel strip is loosened to move in a zigzag fashion, if the tension of the steel strip is low. Furthermore, at the outlet of the heating zone 1 and in the soaking zone 2, the steel strip is heated to a high temperature to be softened and becomes low in its yielding point, and hence, if the tension of the steel strip is too high, then there occurs a possibility of that the value of plastic deformation of the steel strip is increased, thus resulting elongation in the longitudinal direction and in shrinkage in the widthwise direction. Namely, it is desirable that the tension of the steel strip in the heating zone 1 is set at a high value and the tensions of the steel strip at the outlet of the heating zone 1 and in the soaking zone 2 are set at values lower than the former.

However, in the conventional continuous annealing furnace the bridle rolls 5 are provided only at the inlet and outlet of the furnace as described above, the tension of the steel strip over all the furnace is held at a predetermined value by the dancer roll 6 provided at the inlet of the furnace, whereby the actual tension of the steel strip is in a uniformly stretched condition over all the furnace as shown in a chart of FIG. 1. Consequently, in the continuous annealing furnace as described above, it is impossible to obtain such a discontinuous variation of the tension of the steel strip in the furnace that the tension of the steel strip in the heating zone 1 is set at the high value and the tensions of the steel strip at the outlet of the heating zone 1 and in the soaking zone 2 are set at the values lower than the former.

FIG. 2 is an explanatory view showing the conventional annealing furnace for annealing the soft black tinplates or the cold-rolled steel sheets for drawing and the tension of the steel strip in the furnace. In this continuous annealing furnace, the steel strip is annealed through a heating zone 11, a soaking zone 12 and a quenching zone 13, a controlled cooling zone 14 and a rapidly cooling zone 15 as the cooling zones, and thereafter, carried out of the furnace. The tension control in this continuous annealing furnace, similarly to that in the continuous annealing furnace as shown in FIG. 1, is effected in such a manner that the tension of the steel strip is isolated by the bridle rolls 5 provided at the inlet and outlet of the furnace and the motor torque of the dancer roll 6 interposed between the bridle roll 5 at the inlet and the heating zone 11 is changed.

However, the steel strip is rapidly cooled at a high cooling rate in the quenching zone 13, whereby irregularities in cooling tend to occur, and if the tension is excessively high, then irregular shapes of the steel strip and cooling buckling may take place. Consequently, the tension of the steel strip in the quenching zone 13 is required to be set at a value lower than those in other zones.

Nevertheless, in the conventional continuous annealing furnace, only the tension control over all the furnace is effected as described above, whereby the actual tension of the steel strip is in a uniformly stretched condition over all the furnace as shown in a chart of FIG. 2, and hence, the tension of the steel strip only in the quenching zone 13 cannot be set at a discontinuously low value.

More specifically, in the conventional continuous annealing furnace, the conditions of tension in the respective zones of the furnace cannot be controlled independently of one another, thus presenting the problems including the ruptures in the steel strip due to the movement of the steel strip in a zigzag fashion, damages caused to the furnace, fluctuations in width of the steel strip, irregular shapes of the steel strip, local fluctuations in shapes of the steel strip and the like. In addition, in some of the conventional continuous annealing furnaces, the motor torque for the hearth rolls are controlled in the respective zones, so that the tensions of the steel strip in the respective zones can be varied. However, the motor for the hearth rolls is adapted to have a so low capacity as to supplement the torque required for the rotation of the rolls, so that such a control cannot be effected as to bring about great changes in tension between the respective zones.

SUMMARY OF THE INVENTION

The present invention has been developed to obviate the disadvantages of the prior art and has as its object the provision of a steel strip continuous annealing furnace, wherein appropriate tensions are rendered to the steel strip in the respective zones of the continuous annealing furnace independently of one another, so that stabilized operating conditions can be secured.

To achieve the abovedescribed object, according to the present invention, in a steel strip continuous annealing furnace comprising a heating zone, a soaking zone and cooling zones, bridle rolls for isolating the tension of the steel strip from those in adjacent sections of the steel strip are provided at the inlet and outlet of the furnace and in the furnace, whereby a plurality of tension control blocks are defined in the furnace so as to provide a tension control mechanism for controlling the tensions of the steel strip per tension control block.

BRIEF DESCRIPTION OF THE DRAWINGS

The abovementioned features and object of the invention will become more apparent with reference to the following description, taken in conjunction with the accompanying drawings, wherein like reference numerals denote like elements, and in which.

DETAILED DESCRIPTION OF THE INVENTION

Figure 1:
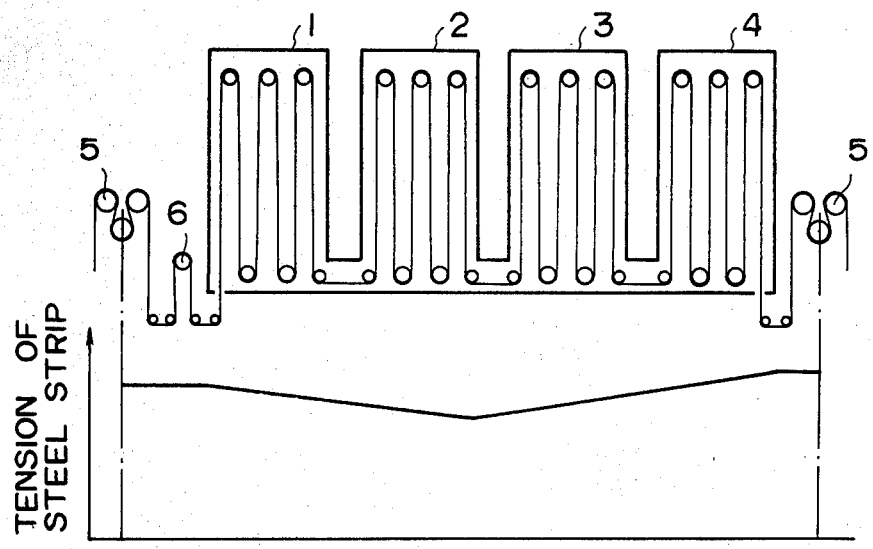
FIG. 1 is an explanatory view showing the conventional steel strip continuous annealing furnace and the condition of tension of the steel strip in the furnace.
Figure 3:
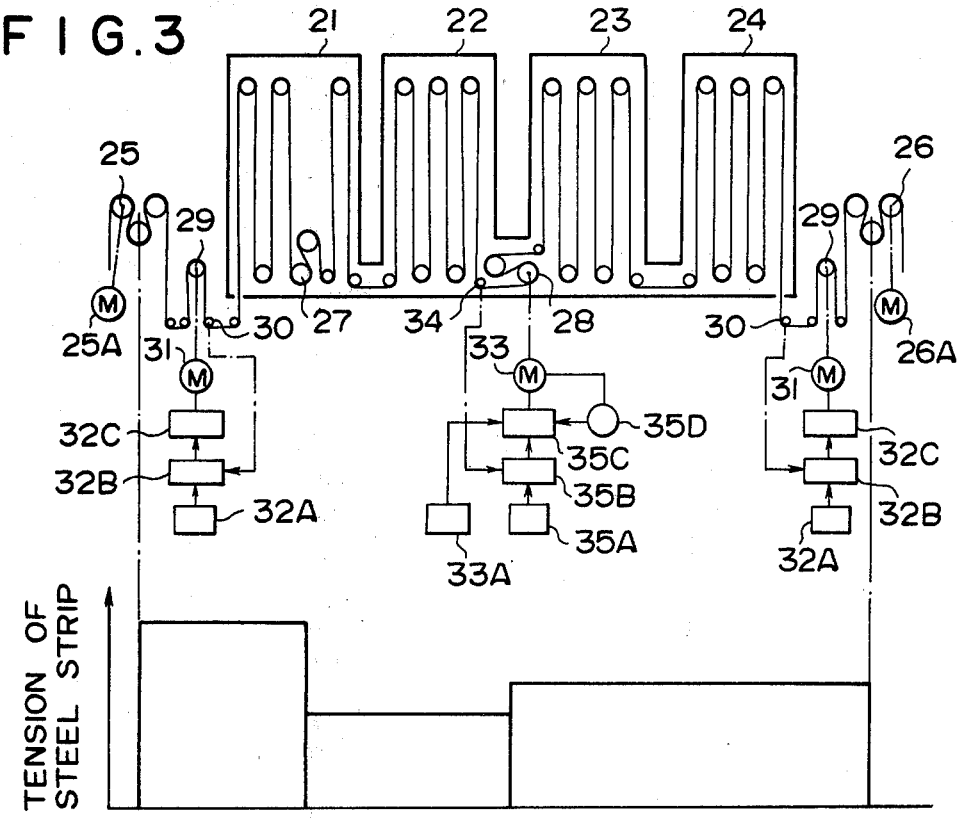
FIG. 3 is an explanatory view showing a first embodiment of the steel strip continuous annealing furnace according to the present invention and the condition of tension of the steel strip in the furnace.
Figure 2:
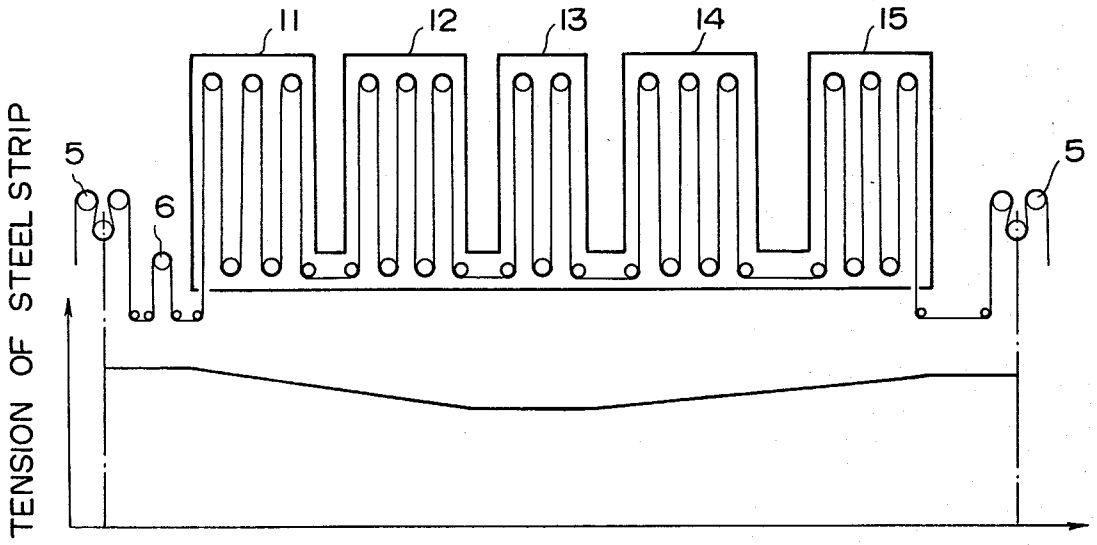
FIG. 2 is an explanatory view showing another embodiment of the conventional continuous annealing furnace and the condition of tension of the steel strip in the furnace.

Description will hereunder be given of the embodiments of the present invention with reference to the drawings.

FIG. is an explanatory view showing the first embodiment of the steel strip continuous annealing furnace according to the present invention. This continuous annealing furnace is used for annealing the black tinplates, silicon steel sheets or the like, and comprises: a heating zone 21 for heating the steel strip to a predetermined temperature; a soaking zone 22 for holding the steel strip at a predetermined temperature for a preset period of time; a controlled cooling zone 23 for controlled cooling the steel strip or holding same at a predetermined temperature for overaging same; and a rapidly cooling zone 24 for rapidly cooling the steel strip to substantially room temperature. Here, at the inlet of the furnace, there is provided a steel strip feeder including an uncoiler, a cleaning equipment, an inlet looper and the like and at the outlet of the furnace, there is provided a steel strip carry-out device including an outlet looper, sampling means, a recoiler and the like.

Furthermore, a bridle roll 25 is provided forwardly of a heating zone 21, a bridle roll 26 is provided rearwardly of a rapidly cooling zone 24, a bridle roll 27 is provided at the outlet of the heating zone 21, and a bridle roll 28 is provided at the outlet of a soaking zone 22. The bridle rolls 25, 26, 27 and 28 are formed into cylinders each having axially uniform diameters so that the contact area between the steel strip and the roll can be made large to minimize the contact surface pressure therebetween, and the frictional coefficient therebetween is made high to increase the difference in tension between portions of the steel strip forwardly and rearwardly of the roll, so that the tensions at the portions of the steel strip forwardly and rearwardly of the position where the rolls are provided, can be isolated. Consequently, the interior of the furnace is divided by adjacent bridle rolls 25, 26, 27 and 28, whereby a plurality of tension control blocks are formed which are variable in tension discontinuously from one to another.

Provided between the bridle roll 25 and the inlet of the heating zone 21 and between the bridle roll 26 and the outlet of the rapidly cooling zone 24 are dancer rolls 29 constituting tension control mechanisms, respectively. Tension meter rolls 30 for detecting the actual tensions of the steel strip are provided at positions close to the dancer rolls 29, respectively, and torque motors 31 can control through the dancer rolls 29, respectively, tensions of the steel strip in a tension control block defined by the bridle rolls 25 and 27 and a tension control block defined by the bridle rolls 26 and 28. Here, the dancer rolls 29, which have been vertically displaced to control the tensions are restored to a vertically central position as the original position by changing the rotational speed of the driving motors 25A, 26A for the bridle rolls 25, 26.

More specifically, the tensions required for the respective tension control blocks are transmitted to tension controllers 32B as command signals 32A, the tension controllers 32B, based on comparison between output values from the tension meter rolls 30 and the command signals 32A, rotate the torque motors 31 in the normal or reverse direction for the number of rotations required through motor torque controllers 32C to vertically move the dancer rolls 29, whereby the tensions of the respective tension control blocks are controlled to the conditions required by the command signals 32A.

Furthermore, either one of the bridle roll 27 or the bridle roll 28 (in this embodiment, the bridle roll 28) is connected thereto with a rotatably driving motor 33 constituting a tension control mechanism and rotating the bridle rolls 27, 28 is such a manner that the steel strip can be conveyed at a predetermined conveying speed based on a steel strip conveying speed command 33A. A tension meter roll 34 is provided in the tension control block defined by the bridle rolls 27 and 28. The tension required for the tension control block defined by the bridle rolls 27 and 28 is transmitted to a tension controller 35B as a command signal 35A, the tension controller 35B, based on comparison between the command signal 35A and an output value of the tension meter roll 34, controls the number of rotations of the rotatably driving motor 33 through a rotation number controller 35C, whereby the rotation of the bridle roll 28 is varied, so that the tension in this tension control block can be controlled to the required condition. In addition, the number of rotations of the rotatably driving motor 33 is fed back to the rotation number controller 35C through a rotation number detector 35D.

Description will hereunder be given of action in the abovedescribed embodiment. Upon being cold-rolled, the steel strip is wound out by an uncoiler, not shown, cleaned by a cleaning equipment, and thereafter, introduced into the furnace through the inlet looper. Here, in the case the steel strip is one for producing silicon steel sheets, the steel strip is elevated in temperature to approx. 850° C. in the heating zone 21 to obtain a predetermined electromagnetic characteristics, held for more than 60 sec in the soaking zone 22, cooled to substantially room temperature in the controlled cooling zone 23 and the rapidly cooling zone 24, thereafter, carried out of the furnace, and wound up through the outlet looper and sampling means.

Here, tension of the steel strip defined by the bridle rolls 25 and 27 mainly in the heating zone 21 is maintained at a required high tension condition through the tension controller 32B for receiving the command signal 32A and the output value emitted from the tension meter roll 30, the torque motor 31 being controllable by the motor torque controller 32C and the dancer roll 29. Tension of the steel strip defined by the bridle rolls 27 and 28 at the outlet of the heating zone 21 and in the soaking zone 22 is maintained at a required low tension condition by the tension controller 35B for receiving the command signal 35A and the output value emitted from the tension meter roll 34, the rotatably driving motor 33 being controllable by the rotation number controller 35C and the bridle roll 28. Tension of the steel strip defined by the bridle rolls 26 and 28 mainly in the controlled cooling zone 23 and the rapidly cooling zone 24, in the same manner as in the operation in the heating zone 21, is maintained at a required tension condition by the vertical control of the dancer roll 29. In addition, when the number of rotations of the bridle roll 28 disposed in the furnace is fluctuated, the fluctuation affects the tension of the steel strip in the tension control block that follows. However, the fluctuation in tension is immediately detected by the tension meter roll 30 in the tension control block that follows, so that the required tension condition based on the command signal 32A can be maintained.

In the abovedescribed first embodiment, the tension of the steel strip in the furnace is changeable in the tension control blocks defined by the bridle rolls 25, 26, 27 and 28 independently of one another. More specifically, the tension of the steel strip in the heating zone 21 is in the high tension condition and the steel strip does not become loose or has a danger of moving in a zigzag fashion despite elongation of the steel strip due to thermal expansion. Furthermore, the tension of the steel strip at the outlet of the heating zone 21 and in the soaking zone 22 is maintained at a low tension condition and no great plastic deformation is caused despite lowered yield point of the steel strip. In addition, in the case the tension of the steel strip in the soaking zone 22 in the abovedescribed embodiment is maintained at a low tension condition corresponding to 60% of the conventional example, it has been recognized that elongation of the steel strip after the continuous annealing can be considerably improved as shown in Table 1.

TABLE 1

| | Soaking temperature | Tension of steel strip in soaking zone | Rate of Elongation in length of steel strip due to annealing |
|---|---|---|---|
| Prior art | 850° C. | 1kg/mm$^2$ | 1.8% |
| Present invention | 850° C. | 0.6kg/mm$^2$ | 0.74% |

Figure 4:
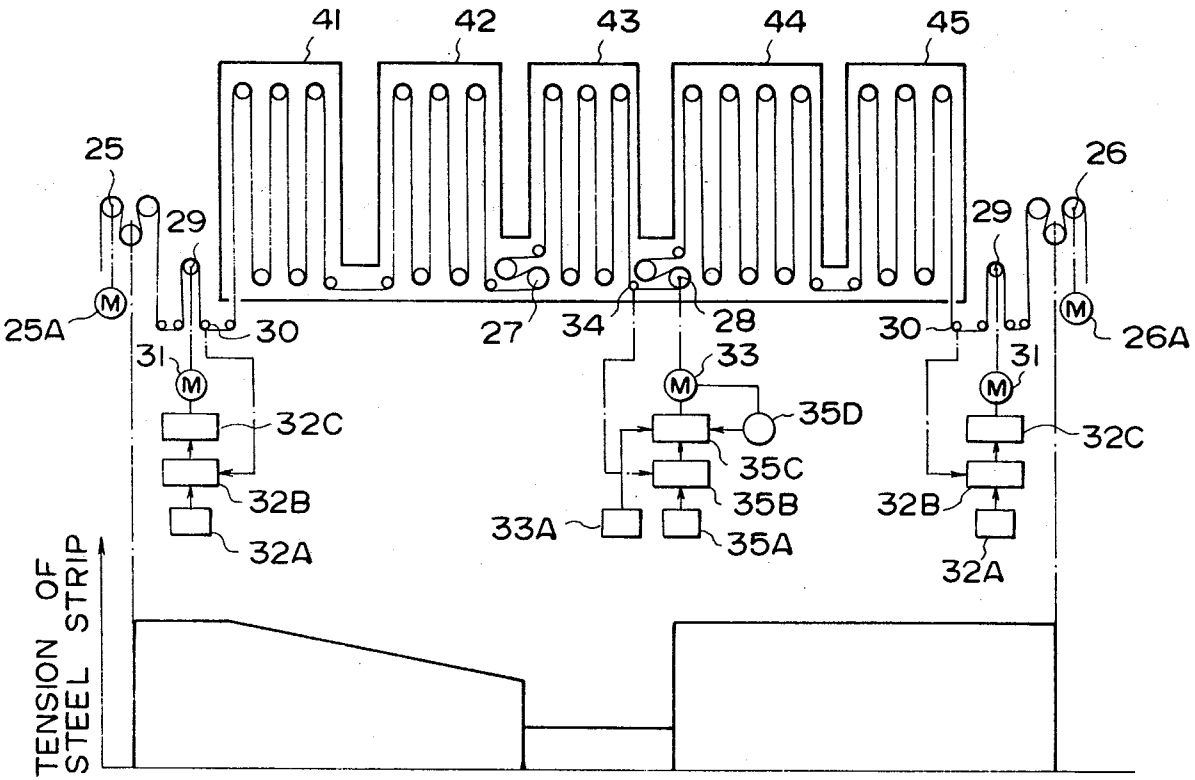
FIG. 4 is an explanatory view showing a second embodiment of the steel strip continuous annealing furnace according to the present invention and the condition of tension of the steel strip in the furnace.

FIG. 4 is an explanatory view showing a second embodiment of the continuous annealing furnace according to the present invention. This continuous annealing furnace can anneal the soft black tinplates or the cold-rolled steel sheets for drawing, and comprises a heating zone 41, a soaking zone 42, a controlled cooling zone 44, a quenching zone 43 and a rapidly cooling zone 45. In this second embodiment, bridle rolls 25, 26 similar to ones in the abovedescribed first embodiment are provided at the inlet and outlet of the furnace, respectively, and bridle rolls 27, 28 are disposed at the inlet and outlet of a quenching zone 43, respectively. More specifically, in this second embodiment, a heating zone 41 and a soaking zone 42 defined by the bridle rolls 25 and 27, a quenching zone 43 defined by the bridle rolls 27 and 28, and a controlled cooling zone 44 and a rapidly cooling zone 45 defined by the bridle rolls 28 and 26 form tension control blocks independent of one another, respectively.

Furthermore, as shown in FIG. 4 tension control mechanisms for controlling the tensions to required conditions by vertically moving dancer rolls 29 similar to ones in the abovedescribed first embodiment are provided in the tension control block including the heating zone 41 and the soaking zone 42 and the tension control block including the controlled cooling zone 44 and the rapidly cooling zone 45. Furthermore, as shown in FIG. 4, there is provided a tension control mechanism for controlling the tension in the tension control block of the quenching zone 43 to a required condition through the rotatably driving motor 33 in the same manner as in the abovedescribed first embodiment. More specifically, the tension of the steel strip in this second embodiment is set in a low tension condition in the quenching zone 43, before and behind which the tensions of the steel strip are set in higher tension conditions than the former.

Description will hereunder be given of action in the abovedescribed second embodiment. In the case the steel strip carried into the furnace is one for producing soft black tinplates, the steel strip is elevated in temperature to approx. 700° C. in the heating zone 41, soaked at approx. 700° C. for more than 20 sec in the soaking zone 42, cooled to approx. 400° C. at a cooling rate of approx. 40° C./sec in the quenching zone 43, held at approx. 400° C. for more than 60 sec in the controlled cooling zone 44, cooled to substantially room temperature in the rapidly cooling zone 45, and thereafter, the steel strip thus annealed is carried out of the furnace.

Here, the tension of the steel strip in the heating zone 41 and the soaking zone 42 is maintained in a predetermined tension condition by the tension controller 32B for receiving the command signal 32A and the output value emitted from the tension meter roll 30, the torque motor 31 controllable by the motor torque controller 32C and the dancer roll 29. Furthermore, the tension of the steel strip in the controlled cooling zone 44 and the rapidly cooling zone 45 is maintained likewise in a required tension condition by the vertically moving dancer roll 29. The tension of the steel strip in the quenching zone 43 is maintained in a required low tension condition by the tension controller 35B for receiving the command signal 35A and the output value emitted from the tension meter roll 34, the rotatably driving motor 34 driven by the rotation number controller 35C and the bridle roll 28.

More specifically, in the abovedescribed second embodiment, required tensions of the steel strip are maintained in the respective tension control blocks defined by the bridle rolls 25, 26, 27 and 28 and the tension of the steel strip in the quenching zone 43 can be set at a value lower than those in the tension control blocks disposed before and behind the quenching zone 43, and hence, despite that the steel strip tends to cause irregularities in cooling under a high cooling rate, irregular shapes of the steel strip or cooling buckling is not caused. In addition, as for the down time A for stopping the line or decreasing the line speed due to an unsatisfactory shape of the steel strip in the quenching zone 43 and the down time B for stopping the line or decreasing the line speed due to occurring of cooling buckling, it is recognied that those down times can be improved to a considerable extent as shown in Table 2 by decreasing the tension of the steel strip in the quenching zone 43 in the abovedescribed second embodiment to the level of ⅓ that of the conventional example.

TABLE 2

| | Dimensions of steel strip (mm) | | Cooling rate in rapidly cooling zone | Tension of steel strip in rapidly cooling zone | Down Time | |
|---|---|---|---|---|---|---|
| | Sheet thickness | Sheet width | | | A | B |
| Prior art | 0.20 ~ 0.30 | 730 ~ 930 | 40° C./sec | 1.2kg/mm$^2$ | 12 Hr/Mon | 29 Hr/Mon |
| Present invention | 0.20 ~ 0.30 | 730 ~ 930 | 40° C./sec | 0.4kg/mm$^2$ | 7 Hr/Mon | 11 Hr/Mon |

As has been described hereinabove, according to the present invention, in a steel strip continuous annealing furnace comprising a heating zone, a soaking zone and cooling zones, bridle rolls for isolating tension of the steel strip from those in adjacent sections of the steel strip, respectively, are provided at the inlet and outlet of the furnace and in the furnace so as to define a plurality of tension control blocks, and tension control mechanisms are provided for controlling the tensions of the steel strip in the respective tension control blocks, so that appropriate tensions can be rendered to the steel strip in the respective zones in the furnace, thus enabling to secure the safe and satisfactory operating conditions.

It should be apparent to one skilled in the art that the abovedescribed embodiments are merely illustrative of but a few of the many possible specific embodiments of the present invention. Numerous and varied other arrangements can be readily devised by those skilled in the art without departing from the spirit and scope of the invention.

What is claimed is:

1. A steel strip continuous annealing furnace comprising a heating zone, a soaking zone or a heating-soaking zone and cooling zone, wherein a plurality of sets of bridle rolls engaging with a steel strip to isolate tension of the steel strip in the longitudinal direction of the steel strip are provided at the front outer side and at the back outer side of the furnace and within the furnace so as to define a plurality of tension control blocks between each of adjacent said bridle rolls, and a plurality of tension control mechanisms are provided for each of said tension control blocks for controlling the tension of the steel strip isolated within of said tension control blocks whereby the tension within each tension control block can be controlled independently of the tension in other said tension control blocks.

2. A steel strip continuous annealing furnace as set forth in claim 1, wherein said bridle rolls within the furnace are disposed between the heating zone and the soaking zone, and between the soaking zone and the cooling zone adjacent to the soaking zone, respectively.

3. A steel strip continuous annealing furnace as set forth in claim 1, wherein said cooling zone include a rapidly cooling zone and said bridle rolls are provided at both opposite ends of said rapidly cooling zone, respectively.

4. A steel strip continuous annealing furnace as set forth in claim 1, wherein said tension control mechanism each comprise:

a tension meter roll for detecting the actual tension of the steel strip in a tension control block;

a tension controller for comparing an output value emitted from the tension meter roll with a command signal as an intended tension in the tension control block;

a dancer roll for coming into frictional contact with the steel strip in the tension control block to control the tension of the steel strip;

a torque motor for vertically moving the dancer roll; and a motor torque controller for rotatably controlling the torque motor based on an output value emitted from the tension controller.

5. A steel strip continuous annealing furnace as set forth in claim 1, wherein said tension control mechanism comprises:

a tension meter roll for detecting actual tension of the steel strip in the tension control block;

a tension controller for comparing an output value emitted from said tension meter roll with a command signal as an intended tension in the tension control block;

a rotatably driving motor for rotating the bridle roll; and a rotational speed controller for rotatably controlling said rotatably driving motor based on an output value emitted from said tension controller.

* * * * *